US006824456B2

(12) United States Patent
Ebner et al.

(10) Patent No.: US 6,824,456 B2
(45) Date of Patent: Nov. 30, 2004

(54) CONFIGURATION FOR POLISHING DISK-SHAPED OBJECTS

(75) Inventors: Katrin Ebner, Dresden (DE); Walter Glashauser, Oberhaching (DE)

(73) Assignee: Infineon Technologies SC300 GmbH & Co. KG, Dresden (DE)

( * ) Notice: Subject to any disclaimer, the term of this patent is extended or adjusted under 35 U.S.C. 154(b) by 0 days.

(21) Appl. No.: 10/403,880

(22) Filed: Mar. 31, 2003

(65) Prior Publication Data

US 2003/0181061 A1 Sep. 25, 2003

Related U.S. Application Data

(63) Continuation of application No. PCT/EP01/10186, filed on Sep. 4, 2001.

(30) Foreign Application Priority Data

Sep. 29, 2000 (EP) ..... 00121485

(51) Int. Cl.[7] ..... B24B 7/00

(52) U.S. Cl. ..... 451/287; 451/396; 451/397; 451/398; 451/402

(58) Field of Search ..... 451/285–287, 451/41, 396, 397, 398, 402

(56) References Cited

U.S. PATENT DOCUMENTS 5,335,457 A 8/1994 Matsuda et al.
5,527,209 A * 6/1996 Volodarsky et al. ..... 451/388
5,538,465 A 7/1996 Netsu et al.
5,618,354 A * 4/1997 Lofaro ..... 134/25.4
5,820,448 A 10/1998 Shamouilian et al.
5,876,273 A * 3/1999 Yano et al. ..... 451/288
5,885,135 A * 3/1999 Desorcie et al. ..... 451/41
6,012,964 A 1/2000 Arai et al.
6,030,275 A * 2/2000 Lofaro ..... 451/5
6,074,288 A 6/2000 Nagahara et al.
6,113,466 A * 9/2000 Lin ..... 451/41
6,117,776 A 9/2000 Huber et al.
6,171,513 B1 * 1/2001 Davis et al. ..... 216/88
6,309,290 B1 * 10/2001 Wang et al. ..... 451/398
6,344,414 B1 * 2/2002 Davis et al. ..... 438/692
6,371,833 B1 * 4/2002 Huckels et al. ..... 451/41
6,537,141 B1 * 3/2003 Liu et al. ..... 451/285
6,612,915 B1 * 9/2003 Uzoh et al. ..... 451/285

* cited by examiner

*Primary Examiner*—M. Rachuba
(74) *Attorney, Agent, or Firm*—Laurence A. Greenberg; Werner H. Stemer; Gregory L. Mayback

(57) ABSTRACT

A polish head for Chemical Mechanical Polishing includes a backing film of silicone on a rigid support element, preferably, of amorphous ceramic. The silicone backing film is fabricated by molding, thereby enabling an appropriate cross-sectional shape for specific polishing needs. The head provides a uniform polishing of a semiconductor wafer.

20 Claims, 3 Drawing Sheets

CONFIGURATION FOR POLISHING DISK-SHAPED OBJECTS

CROSS-REFERENCE TO RELATED APPLICATION

This application is a continuation of copending International Application No. PCT/EP01/10186, filed Sep. 4, 2001, which designated the United States.

BACKGROUND OF THE INVENTION

FIELD OF THE INVENTION

The invention refers to a configuration for polishing diskshaped objects including a polish platen and a polish head with a backing film, especially for polishing semiconductor wafers.

In semiconductor wafer manufacturing, the wafer obtains an uneven surface in the process of depositing and growing of different films and materials. Especially with small feature sizes, these non-planarities of the wafer surface lead to alignment errors during lithography. A common process to improve uniformity is a polishing of the wafer surface. The backside of the wafer is held by a polish head of the polishing tool and the front side to be polished is moved across a pad on the platen of the polish tool. The head is rotated around its own axis as well as around another axis together with multiple polishing heads. A slurry including a specific composition of different ingredients interacts between the wafer and the polish pad to provide appropriate polish effects as well as cooling. This process of polishing semiconductor wafers is referred to as Chemical Mechanical Polishing (CMP). CMP may also be applied to other manufacturing processes of disk-shaped objects such as CDs or flat panel substrates or the like.

One critical factor in CMP is uniformity. When the backside of the wafer within the polishing head is supported by a polyurethane film there are inherent disadvantages. Polyurethane is inhomogeneous, having zones of different hardness and different density. This is due to the fact that a polyurethane backing film is fabricated by foaming, which is poorly controllable. The film is cut off from bulk material. The polyurethane backing film has varying compressibility so that the force applied to the wafer backside results in an inhomogeneous polishing result on the polished surface of the wafer.

Another disadvantage of polyurethane backing films is that the film sucks liquid into its holes of the foam structure. Especially those holes that are cut and open on the surface of the backing film accept liquid from the slurry. The sucking of liquid into the polyurethane backing film results in a further introduction of non-uniformity to the polishing process.

In U.S. Pat. No. 6,012,964 to Arai et al., a CMP apparatus is disclosed that seeks to improve uniformity. The polish head has a soft backing pad facing the backside of the wafer to be polished that is supported by a hard sheet. The hard sheet is applied with air pressure to adjust the shape of the hard sheet and compensate uniformity problems. The backing film can be made of various materials including silicone rubber. The shape of the surface of the hard sheet is controlled by the air pressure applied to the pressure chamber behind the hard sheet. Because the surface shape of the hard sheet is not rigid and depends on the pressure applied to the pressure chamber, uniformity problems remain.

SUMMARY OF THE INVENTION

It is accordingly an object of the invention to provide a configuration for polishing disk-shaped objects that overcomes the hereinafore-mentioned disadvantages of the heretofore-known devices of this general type and that provides better uniformity during polishing.

With the foregoing and other objects in view, there is provided, in accordance with the invention, a configuration for polishing disk-shaped objects having a first surface and a second surface opposite the first surface, including a platen adapted to contact the first surface of an object to be polished and a polish head having a backing film removably attached to the polish head and adapted to directly contact the second surface, the backing film being of silicone and a rigid support element carrying the backing film.

In accordance with another feature of the invention, the object is a semiconductor wafer, in particular, a silicon wafer.

A configuration for polishing disk-shaped objects includes a platen that contacts a first surface of the object that is to be polished, a polish head that includes a backing film that is removably attached to the polish head to directly contact a second surface of the object opposite to the surface to be polished, and a support element carrying the backing film that is rigid, the backing film being of silicone.

The polish head according to the configuration of the invention has a rigid, incompressible support for the backing film, the surface of which having a constant shape. For better uniformity and controllability of the polish process, the backing film that holds the backside of the wafer is formed of silicone. Compared to a polyurethane backing film that is made from a foam, silicone has the advantage that it is made from a liquid. The liquid is introduced into a molding form. Compared to the poorly controllable process of foaming, the result of molding a backing film can be tightly controlled.

Because the silicone backing film is made from a liquid phase, the finished backing pad is an inherently uniform material having the same density and compressibility throughout its body. A silicone backing pad does not leak any air so that it can be attached to the polish head by underpressure. There is no need to glue the backing film to its support on the polish head so that uniformity is further improved. By avoiding any glue, a backing film can easily be replaced by a new silicone backing film at the end of its lifetime. Preferably, the support for the backing film is a ceramic plate or chuck that is rigid and provides an incompressible support for the backing film, the surface of which always having the same constant shape. A ceramic chuck is amorphous so that an evenly distributed vacuum can be provided through the ceramic chuck to hold the backing film onto the chuck. This vacuum is provided by a vacuum chamber at the surface of the ceramic chuck that is opposite to the backing film. The ceramic chuck contacts the backing film directly.

In accordance with a further feature of the invention, the vacuum generator supplies a vacuum to the support element to hold the backing film on the support element.

In accordance with an added feature of the invention, the polish head has a first vacuum chamber supplying a vacuum to the ceramic support element, a second vacuum chamber above the first vacuum chamber, and a plurality of tubes projecting from the second vacuum chamber through the first chamber, through the ceramic support element, and through the backing film to end above the second surface of the object, the tubes supplying a vacuum to the second surface of the object to hold the object onto the backing film.

There is another vacuum chamber that provides a vacuum to the backside of the wafer through tubes. The tubes are projecting from this latter vacuum chamber through the chamber providing the vacuum to the ceramic chuck, are protruding through the ceramic chuck, are protruding through the silicone backing film, and, finally, are ending close to the back surface of the wafer.

In accordance with an additional feature of the invention, the backing film has a surface adapted to directly contact the second surface of the object, the surface of the backing film having a microstructure with a plurality of enhanced portions contacting the second surface of the object and a plurality of recessed portions not contacting the second surface of the object.

Because the silicone backing film does not leak any air, the wafer is tightly attached to the backing film. To facilitate the removal of the wafer, the surface of the backing film facing the backside of the wafer is provided with a microstructure. The microstructure has enhanced elements that contact the wafer backside and has recessed elements that do not contact the wafer backside. Thereby, the contact area is reduced. The adhesive force holding the wafer at the backing film is, thereby, also reduced. With an appropriate relation between enhanced elements and recessed elements of the microstructure it can be accomplished that the wafer does not stick to the backing film any more when the vacuum for holding the wafer is switched off. The microstructure is applied to the surface of the backing film by a complementary shape in the molding form. This shape can be produced by applying a lithography step comparable to a lithography step for patterning a semiconductor wafer surface during semiconductor wafer manufacturing. To achieve the microstructure through lithography the surface of the molding is subjected to a photoresist that is exposed to optical radiation. The structure is formed by etching the unprotected areas of the molding surface.

In accordance with yet another feature of the invention, the surface of the backing film is concave, convex, or U-shaped defining a macroscopic recess in a center thereof, the recess not contacting the object.

By molding the silicone backing film, it is possible to provide any macroscopic shape to the backing film so that any already known non-uniformity of the wafer to be polished is compensated for. For example, the wafer needs to be polished more in the center than at its end or vice-versa. To compensate for this non-uniformity of the wafer, the backing film can be convex, e.g., the backing film is thicker at its center than at its circumference and can be formed concave, e.g., thinner at its center than at its circumference, respectively. Alternatively, the backing film has a macroscopic recess in its center and projecting parts at its circumference. The center recess does not touch the backside of the wafer whereas the projecting parts contact the wafer. Thereby, a vacuum is enclosed at the center of the backing film. The projecting parts can also be provided with the microstructure. Any other conceivable shape of the surface facing the backside of the wafer can be manufactured by an appropriate complementary shape of the molding.

Another solution to compensate for already known non-uniformities of the wafer to be polished is to provide the backing film with zones of different hardness. Preferably, those zones have concentric shape with respect to the center of the backing film, although different radial sections of the backing film may also have different hardness. All depends on the flexibility of the molding process to fabricate the silicone backing film. The hardness is controllable by the addition of solid particles, like silicon particles or aluminum oxide particles. Other solid materials are possible. Depending on the electrical behavior of the added material, any electrostatic fields introduced during the polish process can be eliminated.

With the objects of the invention in view, there is also provided a configuration for polishing semiconductor wafers having a first surface and a second surface opposite the first surface, including a platen adapted to contact the first surface of a wafer to be polished and a polish head having a backing film removably attached to the polish head and adapted to directly contact the second surface, the backing film being of silicone, a rigid support element carrying the backing film, and a vacuum generator holding the backing film on the support element.

Other features that are considered as characteristic for the invention are set forth in the appended claims.

Although the invention is illustrated and described herein as embodied in a configuration for polishing disk-shaped objects, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
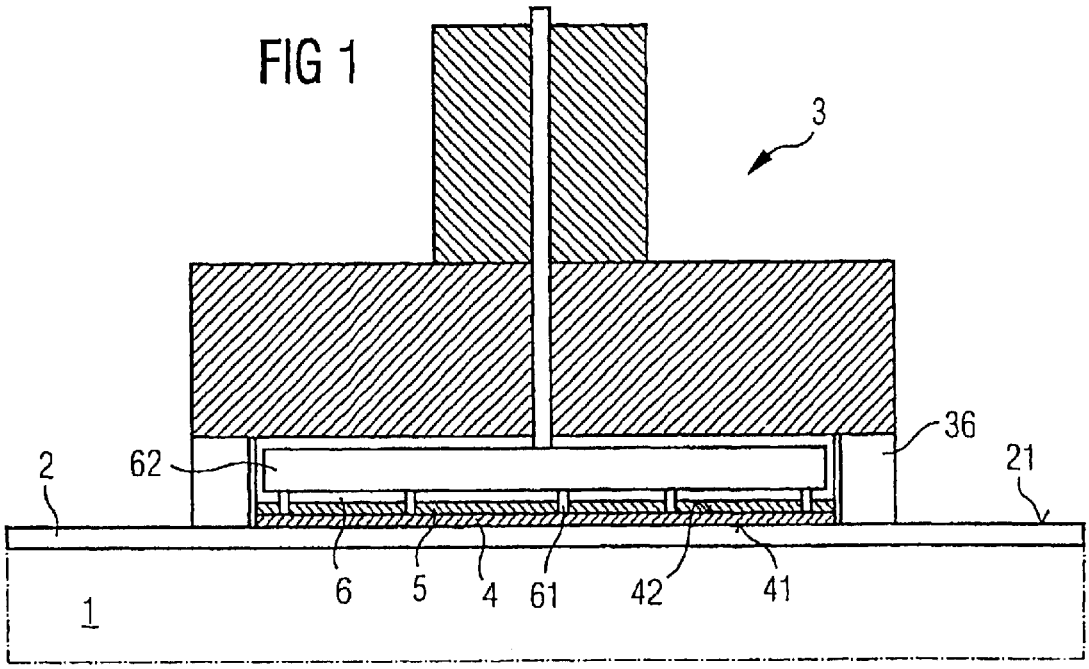
FIG. 1 is a fragmentary, cross-sectional view of a first embodiment of a configuration for polishing a semiconductor wafer according to the invention.

Referring now to the figures of the drawings in detail and first, particularly to FIG. 1 thereof, there is shown a configuration for polishing disk-shaped objects according to the invention. The configuration is especially applicable for polishing semiconductor wafers for the manufacturing of integrated circuits. The configuration includes a table or polish platen 1 on which a polish pad 2 is attached. A polish head 3 holds a wafer 4, the front side 41 of which is moved across the polish pad 2 for polishing. A liquid slurry 21 or a polish pad with fixed abrasive inside of the polish pad is inserted to control friction and to accomplish the Chemical Mechanical Polishing. A configuration of, for example, three or four polish heads is provided, each rotating around its own axis and all of them rotating around the axis of the head configuration. The wafer 4 is pressed onto the polish pad 2 by the polish head 3. The wafer backside is in direct contact with the backing film. In particular, there is no material disposed between the backing film and the wafer backside.

The downforce is applied through a backing film or backing pad 5. The backing film 5 is supported through the polish head by a backing film support 6. The backing film support 6 is rigid having an incompressible, indistortable constant shape. The support 6 withstands the downforce applied to the wafer without any relaxation. According to the invention, the backing film 5 is made of silicone. A retainer ring 36 withstands the radial forces during polish. The support 6 applies a vacuum to the backside of the wafer 4 through a vacuum chamber 62 and vacuum holes 61. By applying the vacuum the wafer is sucked to the backing film 5. By switching off the vacuum, the wafer is released from the backing film 5. Further, a vacuum is supplied to suck the silicone backing film 5 to the support 6.

Figure 2:
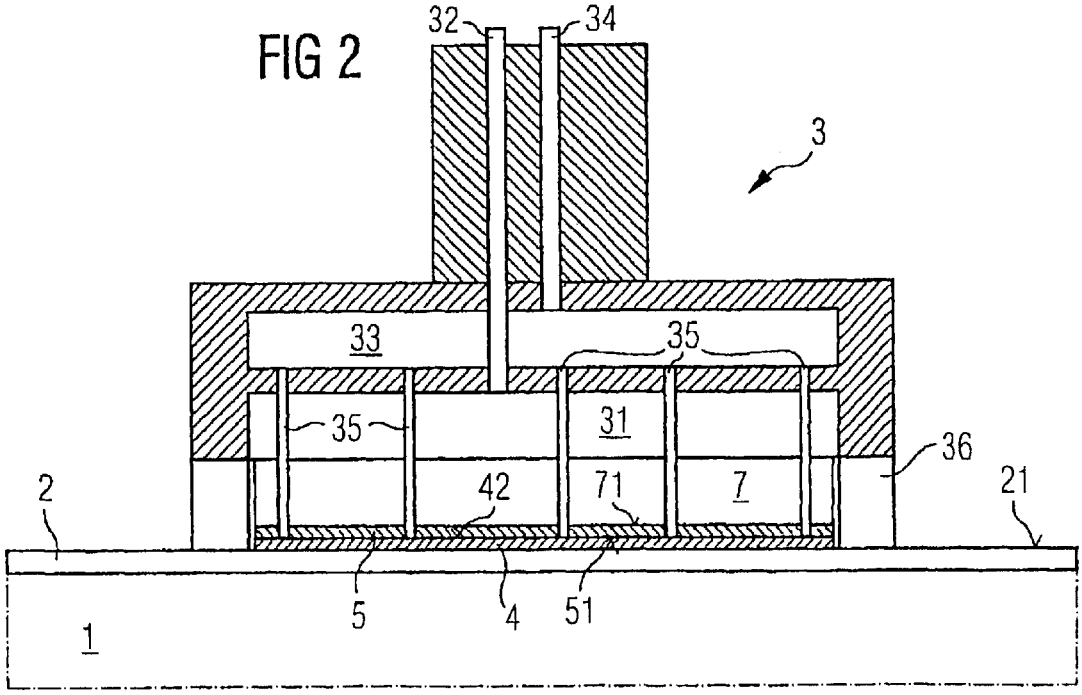
FIG. 2 is a fragmentary, cross-sectional view of a second embodiment of the configuration of FIG. 1.

FIG. 2 shows a preferred embodiment of the polish head 3. The support element for the backing film 5 is a ceramic chuck 7. A vacuum chamber 31 is provided above the ceramic chuck 7. A channel 32 connects the vacuum chamber 31 to a non-illustrated vacuum generator. The ceramic chuck 7, being amorphous, enables the vacuum in the chamber 31 to reach the silicone backing film 5 to suck it to the ceramic chuck 7. With the amorphous ceramic chuck 7, the vacuum in the chamber 31 is evenly distributed across the surface 71 that contacts the silicone backing film. Because silicone does not leak air, the backing film 5 is tightly held on the ceramic chuck 7 and can be released easily by switching off the vacuum in the chamber 31. Compared to a polyurethane backing film, no glue is necessary to stick the backing film to the support (chuck 7) so that a replacement of a used backing film is facilitated and non-uniformities due to air bubbles enclosed by the glue are avoided. The surface 71 of the ceramic chuck is rigid and has a constant shape even when the polish head 3 is pressed onto the platen 1.

An additional vacuum chamber 33 provided with a vacuum by another vacuum channel 34 is disposed above the vacuum chamber 31. Vacuum tubes 35 range from the vacuum chamber 33 through the vacuum chamber 31 also protruding through the ceramic chuck 7 as well as the backing film 5. The tubes 35 are on the backside of the wafer 4. When a vacuum is applied to the backside of the wafer 4 through the vacuum tubes 35, the wafer is tightly held to the backing film 5. When switching off the vacuum after polishing, the wafer is released from the polish head 3.

Figure 3:
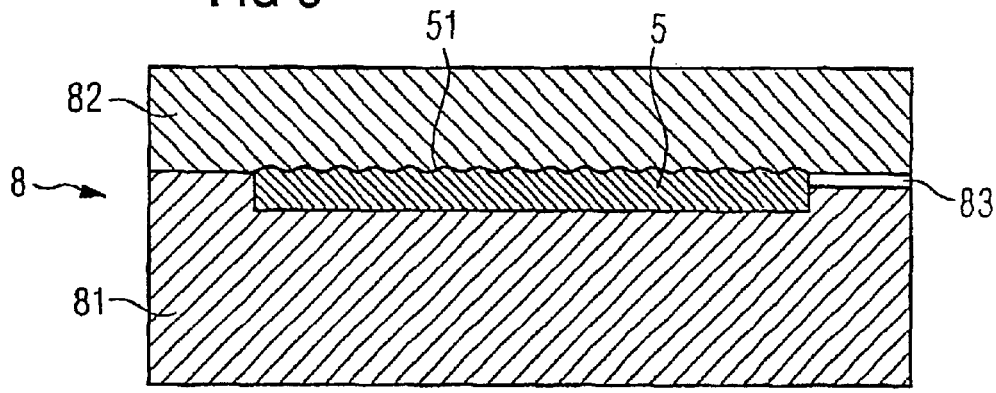
FIG. 3 is a cross-sectional view of a molding form for the fabrication of a silicone backing film according to the invention.

The backing film 5 is fabricated by a molding process in a molding form shown in cross-sectional view in FIG. 3. The molding or casting form 8 has a bottom part 81 and a top part 82. Liquid silicone is inserted through a channel 83 between the top and the bottom parts and is transformed to a solid film. Due to the fact that the silicone film is produced from a liquid, the solid silicone backing film is very homogeneous, having substantially no variation in density and compressibility. Further, the cross-sectional shape of the backing film can be adapted to various requirements. It is also possible to provide the surface of the silicone backing film, which is facing the backside of the wafer to be polished, with a microstructure as explained below. Further, it is possible to insert additional components into the silicone to adopt specific hardness requirements to various radial and/or concentric zones of the silicone backing film.

Figure 4A:
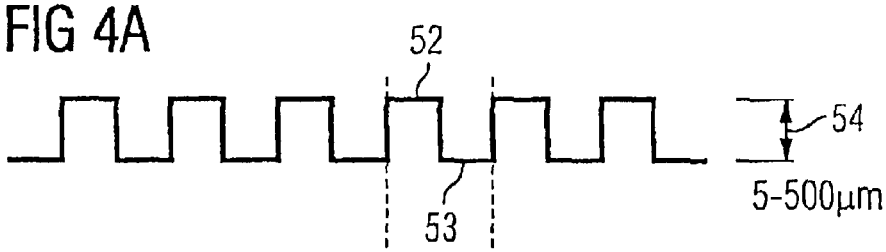
FIGS. 4A, 4B, and 4C are fragmentary, diagrammatic, enlarged cross-sectional views of various embodiments of a microstructure of the surface of a silicone backing film according to the invention.
Figure 4B:
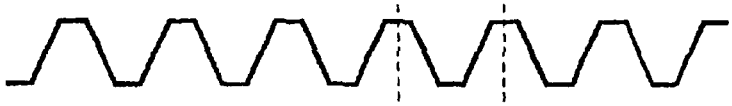
Figure 4C:
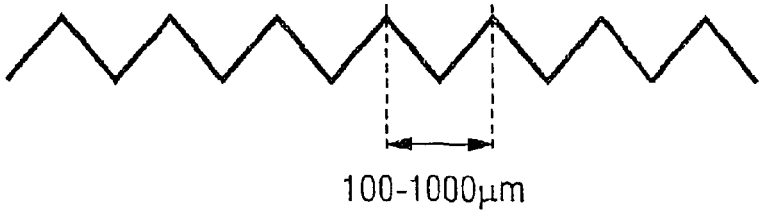

The silicone backing film 5 is impermeable for air. To ease the removal of the wafer 4 from the backing film 5 after polishing of the surface 51, the silicone backing film 5 facing to the backside of the wafer 4 is provided with a microstructure. Preferred embodiments of the microstructure are shown in FIG. 4A, 4B, and 4C. The microstructure has projecting or enhanced portions 52 and recessed portions 53. The enhanced portions 52 make contact to the backside 42 of the wafer 4, whereas the recessed portions 53 do not contact the backside wafer surface 42. With enhanced and recessed portions 52, 53 forming a microstructure, the contact area between the backing film 5 and the wafer backside surface 42 is reduced. The height 54 of the projections is to be adjusted in the range 5 to 500 $\mu$m. The sequence of projections and recesses is regular. Two neighboring projections repeat after 100 to 1000 $\mu$m. A cross-section through a projecting element can be of rectangular shape as shown in FIG. 4A or of tapered shape as shown in FIG. 4B or of triangular shape as shown in FIG. 4C.

The complementary shape of the microstructure is provided by the molding or casting form 8 of FIG. 3 including a bottom part 81 and a top part 82. The top part 82 is provided with the microstructure 51. The microstructure is formed by a lithography process. The top part 82 is, preferably, a metal plate or a glass plate. The top part 82 is coated with a photoresist and structured by light exposure. After developing the photoresist and removal of the developed portions (or undeveloped portions depending on the type of the photoresist), the exposed metal or glass sections are etched by a wet etching chemical or by dry etching (plasma etch). As a result, the structures as shown in FIG. 4A through 4C are achieved. Liquid silicone is fed into the molding form 8 through feeding channel 83 and is then molded.

Figure 5A:
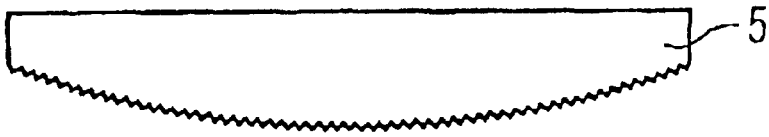
FIGS. 5A to 5D are diagrammatic, enlarged, cross-sectional views through a silicone backing film according to the invention.
Figure 5B:
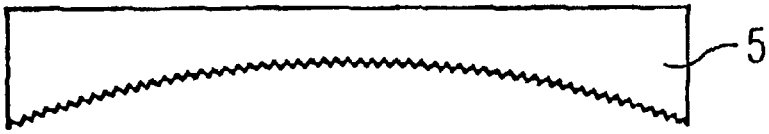
Figure 5C:
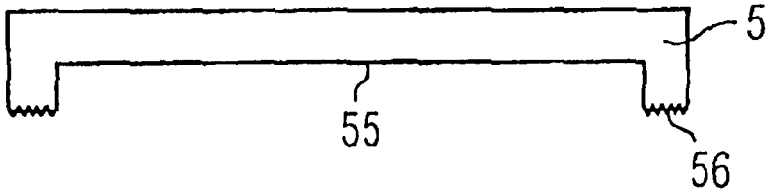

By appropriate macroscopic shaping of the molding in FIG. 3, the various cross-sectional shapes as shown in FIG. 5A through 5C are obtained. The convex form shown in FIG. 5A has a crosssectional shape where the thickness decreases from the center to the circumference. Polishing a wafer with the backside film of FIG. 5A in a polish head of FIGS. 1 or 2 provides faster polishing at the center of the wafer than at the outside portions of the wafer. The macroscopic shape is easily achieved by the appropriate shaping of the top part 82 of the molding form 8. The convex cross-sectional shape of the backing film in FIG. 5B has a smaller thickness in the center that increases radially to its circumference. The concaveness of the backside film can be obtained by an appropriate shape of the top part 82 of the molding form 8. With the concave backing film as shown in FIG. 5B, the center of the wafer is polished more slowly as compared to the outer parts of the wafer. Another preferred shape of the backside film is depicted in FIG. 5C. The macroscopic cross-sectional structure of the circular backing film is U-shaped and has a macroscopic recess 55 at the center and a projecting portion 56 at the circumference. The surface touching the backside of the wafer 4 of the projecting portion 56 has a microstructure as is explained with respect to FIG. 4. The recess section 55 encloses an air cushion behind the wafer.

Figure 5D:
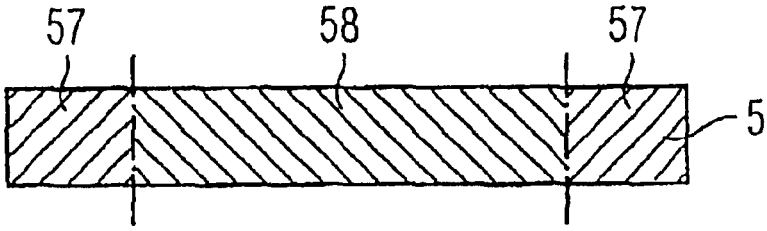

As shown in principle in FIG. 5D, the backing film 5 can have portions of different hardness. For example, the portion 58 in the center of the backing film 5 is harder and has less compressibility than the circular portion 57 surrounding the inner portion 58. The center is polished faster than the outer part of the wafer. Different hardness is achieved by adding particles to the silicone rubber. The particles are mixed into the liquid silicone before the molding form 8 is filled with liquid silicone. The particles may include silicon or aluminum-oxide or a mixture of both. Other particles that do not introduce any contamination to silicon wafers are also possible.

The invention as disclosed above achieves better uniformity of Chemical Mechanical Polishing of semiconductor wafers by various effects. The silicone backing film can, easily, be drawn to the ceramic chuck or support plate within the polish head by the application of a vacuum, thereby avoiding any glue. Such a configuration provides a uniform adhesion of the silicone backing film to the polish head. The replacement of a used and mature backing film is easy and safe, enabling high turnaround time by simply switching the vacuum on and off provided through the amorphous ceramic chuck. The ability to manufacture silicone by molding in an appropriately configured molding/casting form enables the backing film to be adopted to specific polishing characteristics. By appropriate macroscopical shape of the silicone backing film achieved by the molding form, different removal speeds of the material to be polished can be achieved across the wafer surface. A comparable effect can be achieved by an appropriate adding of particles into the silicone. In addition, a microstructure on the contact surface of the backing film to the backside of the wafer serves for good adhesion to the backing film during polishing and easy removal from the backing film when the polish process is finished. Overall, the use of a silicone backing film in a polish configuration according to the invention provides a more accurate polishing and a high turnaround time, thereby providing better quality integrated circuits.

We claim:

1. A configuration for polishing disk-shaped objects having a first surface and a second surface opposite the first surface, comprising:

a platen adapted to contact the first surface of an object to be polished; and a polish head having:

a backing film removably attached to said polish head and adapted to directly contact the second surface, said backing film being of silicone; and a rigid support element carrying said backing film.

2. The configuration according to claim 1, wherein the object is a semiconductor wafer.

3. The configuration according to claim 1, wherein the object is a silicon wafer.

4. The configuration according to claim 1, wherein said support element is an amorphous ceramic.

5. The configuration according to claim 4, wherein said polish head has a vacuum generator supplying a vacuum to said ceramic support element to hold said backing film on said ceramic support element.

6. The configuration according to claim 5, wherein said polish head has:

a first vacuum chamber supplying a vacuum to said ceramic support element;

a second vacuum chamber above said first vacuum chamber; and a plurality of tubes projecting from said second vacuum chamber through said first chamber, through said ceramic support element, and through said backing film to end above the second surface of the object, said tubes supplying a vacuum to said second surface of the object to hold the object onto said backing film.

7. The configuration according to claim 1, wherein said backing film has a surface adapted to directly contact the second surface of the object, said surface of said backing film having a microstructure with:

a plurality of enhanced portions contacting the second surface of the object; and a plurality of recessed portions not contacting the second surface of the object.

8. The configuration according to claim 7, wherein said surface of said backing film is:

concave;

convex; or

U-shaped defining a macroscopic recess in a center thereof, said recess not contacting the object.

9. The configuration according to claim 1, wherein said backing film has concentric zones of different hardnesses.

10. The configuration according to claim 1, wherein said backing film has additives of solid particles.

11. The configuration according to claim 10, wherein said particles are of silicon or aluminum oxide.

12. A configuration for polishing semiconductor wafers having a first surface and a second surface opposite the first surface, comprising:

a platen adapted to contact the first surface of a wafer to be polished; and a polish head having:

a backing film removably attached to said polish head and adapted to directly contact the second surface, said backing film being of silicone;

a rigid support element carrying said backing film; and a vacuum generator holding said backing film on said support element.

13. The configuration according to claim 12, wherein said vacuum generator supplies a vacuum to said support element to hold said backing film on said support element.

14. The configuration according to claim 12, wherein said vacuum generator has:

a first vacuum chamber supplying a vacuum to said support element;

a second vacuum chamber above said first vacuum chamber; and a plurality of tubes projecting from said second vacuum chamber through said first chamber, through said support element, and through said backing film to end above the second surface of the wafer, said tubes supplying a vacuum to said second surface of the wafer to hold the wafer onto said backing film.

15. The configuration according to claim 12, wherein said backing film has a surface adapted to directly contact the second surface of the wafer, said surface of said backing film having a microstructure with:

a plurality of enhanced portions contacting the second surface of the wafer; and a plurality of recessed portions not contacting the second surface of the wafer.

16. The configuration according to claim 15, wherein said surface of said backing film is:

concave;

convex; or

U-shaped defining a macroscopic recess in a center thereof, said recess not contacting the wafer.

17. The configuration according to claim 12, wherein said support element is an amorphous ceramic.

18. The configuration according to claim 12, wherein said backing film has concentric zones of different hardnesses.

19. The configuration according to claim 2, wherein said backing film has additives of solid particles.

20. The configuration according to claim 19, wherein said particles are of silicon or aluminum oxide.

* * * * *